US009390588B2

(12) United States Patent
Elias et al.

(10) Patent No.: US 9,390,588 B2
(45) Date of Patent: Jul. 12, 2016

(54) SYSTEMS AND METHODS FOR DETERMINING AND OUTPUTTING OUTCOMES FOR AN EVENT INSTANCE OF A GAME

(75) Inventors: Hans Elias, St. Albans (GB); David Richard Nulty, Headington (GB); Robert George Thurston, Wadhurst (GB); Thomas David James Aicken, London (GB)

(73) Assignee: Gamesys, Ltd., London (GB)

( * ) Notice: Subject to any disclaimer, the term of this patent is extended or adjusted under 35 U.S.C. 154(b) by 570 days.

(21) Appl. No.: 13/543,458

(22) Filed: Jul. 6, 2012

(65) Prior Publication Data

US 2014/0011565 A1 Jan. 9, 2014

(51) Int. Cl.
*A63F 9/24* (2006.01)
*G07F 17/32* (2006.01)

(52) U.S. Cl.
CPC ..... *G07F 17/3267* (2013.01)

(58) Field of Classification Search
CPC ..... G07F 17/326–17/3283
See application file for complete search history.

(56) References Cited

U.S. PATENT DOCUMENTS

| | | | | |
|---|---|---|---|---|
| 5,393,057 | A | 2/1995 | Marnell, II | |
| 5,560,603 | A | 10/1996 | Seelig et al. | |
| 5,664,998 | A | 9/1997 | Seelig et al. | |
| 5,980,384 | A | 11/1999 | Barrie | |
| 5,997,400 | A | 12/1999 | Seelig et al. | |
| 6,079,711 | A | 6/2000 | Wei et al. | |
| 6,203,428 | B1 | 3/2001 | Giobbi et al. | |
| 6,398,645 | B1 | 6/2002 | Yoseloff | |
| 6,652,378 | B2 | 11/2003 | Cannon et al. | |
| 6,860,810 | B2 | 3/2005 | Cannon et al. | |
| 7,008,319 | B2 | 3/2006 | Montgomery et al. | |
| 7,059,966 | B2 | 6/2006 | Luciano et al. | |
| 7,252,591 | B2 * | 8/2007 | Van Asdale | 463/22 |
| 7,467,999 | B2 | 12/2008 | Walker et al. | |
| 7,513,828 | B2 | 4/2009 | Nguyen et al. | |
| 7,758,416 | B2 | 7/2010 | Randall | |
| 7,806,764 | B2 | 10/2010 | Brosnan et al. | |
| 7,997,981 | B2 | 8/2011 | Rowe et al. | |
| 8,157,633 | B2 | 4/2012 | Kaminkow | |
| 8,333,657 | B1 | 12/2012 | Nelson et al. | |
| 8,388,435 | B2 | 3/2013 | Anderson et al. | |
| 8,475,259 | B2 | 7/2013 | Weber | |
| 8,475,261 | B2 | 7/2013 | Little | |
| 8,496,525 | B2 | 7/2013 | Mosley et al. | |
| 2002/0077167 | A1 | 6/2002 | Merari | |
| 2004/0023714 | A1 * | 2/2004 | Asdale | 463/22 |
| 2004/0087357 | A1 | 5/2004 | Johnson | |

(Continued)

*Primary Examiner* — Tramar Harper
(74) *Attorney, Agent, or Firm* — Fincham Downs, LLC; Magdalena M. Fincham

(57) ABSTRACT

In accordance with some embodiments, methods, systems and articles of manufacture provide for populating a plurality of game symbol positions with primary game symbols affecting a first aspect of the game such that a single primary game symbol is placed in each game symbol position; overlaying, on a randomly selected game symbol position, a special symbol affecting a second aspect of the game, such that the special symbol hides from view the single primary game symbol in the randomly selected game symbol position; outputting a game interface to a player which shows the game symbol positions as populated with the placed primary game symbols and overlaid with the special symbol; and removing the special symbol from the game interface, thereby revealing the single game symbol hidden from view by the special game symbol.

14 Claims, 13 Drawing Sheets

(56) References Cited

U.S. PATENT DOCUMENTS

| | | | | |
|---|---|---|---|---|
| 2006/0073886 | A1 | 4/2006 | Tempest et al. | |
| 2007/0243925 | A1 | 10/2007 | Lemay et al. | |
| 2008/0188279 | A1 | 8/2008 | Seelig et al. | |
| 2009/0069063 | A1 | 3/2009 | Thomas et al. | |
| 2009/0111574 | A1 | 4/2009 | Rowe | |
| 2009/0197659 | A1 | 8/2009 | Christensen | |
| 2009/0197665 | A1 | 8/2009 | Christensen | |
| 2009/0203422 | A1 | 8/2009 | Ellis | |
| 2010/0048289 | A1 | 2/2010 | Mitchell et al. | |
| 2010/0173694 | A1 | 7/2010 | Tsuchida | |
| 2010/0222145 | A1 | 9/2010 | Pececnik et al. | |
| 2011/0287824 | A1* | 11/2011 | Schultz et al. | 463/20 |
| 2012/0315981 | A1 | 12/2012 | Gagner et al. | |
| 2013/0029749 | A1 | 1/2013 | Rucker et al. | |
| 2013/0079116 | A1 | 3/2013 | Nelson et al. | |
| 2013/0116042 | A1 | 5/2013 | Mosley et al. | |

* cited by examiner

400

| | SESSION TURN 402 | MOVEMENTS BACK 404 | SPECIAL SYMBOL PROBABILITY 406 |
|---|---|---|---|
| R405 | 1-3 | 0 | 0.0375 |
| R410 | 4-10 | 2 | 0.075 |
| R415 | 11-20 | 3 | 0.1 |
| R420 | 21+ | 5 | 0.01 |

*FIG. 4*

SYSTEMS AND METHODS FOR DETERMINING AND OUTPUTTING OUTCOMES FOR AN EVENT INSTANCE OF A GAME

BRIEF DESCRIPTION OF THE FIGURES

FIG. 4 is a table representative of one embodiment of a game character movement and special symbol probability database according to one or more embodiments described herein.

DETAILED DESCRIPTION

A. Introduction

Figure 1:
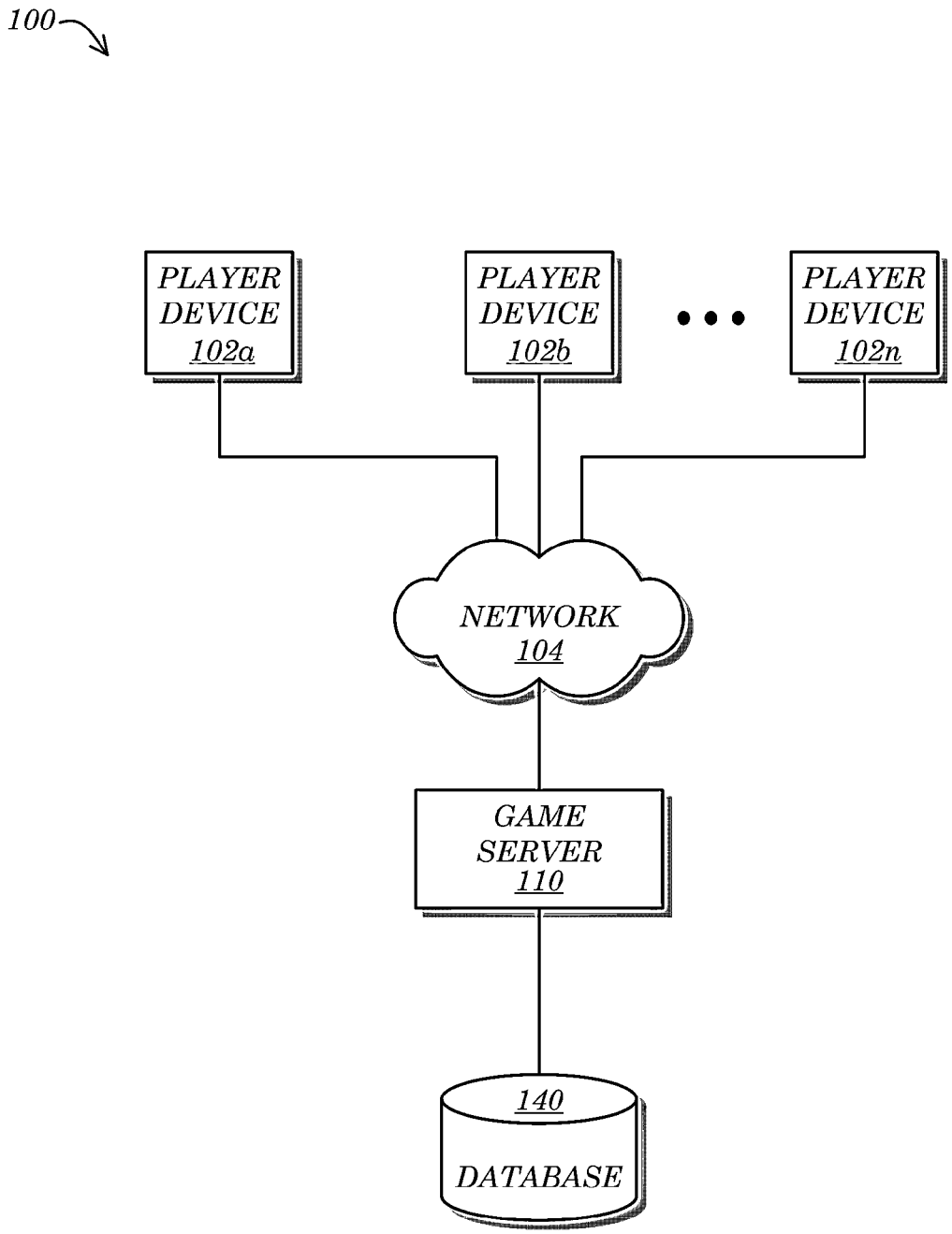
FIG. 1 is a schematic diagram of an embodiment of a gaming system in accordance with one or more embodiments described herein.

Games, whether wagering or non-wagering, are a popular past-time for millions of people all over the world. Electronic games in particular are becoming more and more popular, particularly ones playable online using a computer connected to a network. For example, according to some reports more than 200 million people play social games every month and online games recently passed e-mail as the second-most popular activity online, second only behind social networking. Accordingly, there is a need to continue to create exciting electronic games which maintain players' interest and stand out from the multitude of available online games.

Applicants have recognized that games with multiple aspects which provide layers of results and events provide more excitement to players than do simple games. Applicants have further recognized that games playable over a session in which a plurality of event instances contribute to a session result are particularly enjoyable to many players, as they allow for a build-up of excitement over a period of time and over the plurality of event instances. Applicants have thus created a game, playable online (e.g., which may be embodied as a wagering game) and over a session and which includes at least two aspects played essentially simultaneously or in parallel, each aspect corresponding to a distinct result for a given single event instance of the game. A "session" comprises a period of time spanning a plurality of event instances or turns of the game, the session having a defined start and defined end. An event instance or turn is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance).

An "outcome" should be differentiated from a "result" in the present description in that an "outcome" is a representation of a "result", typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a game in which a character moves along a game interface from a starting position to a finish position, an "outcome" of the game may comprise a symbol representing one or more movements along the interface and the "result" corresponding to this outcome may be the particular number and direction of the character's movement (e.g., three spaces backwards such that the character ends up further away from the finish line). In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass awards, prizes and payouts which are monetary, non-monetary, tangible or intangible.

As described herein, a game consistent with at least some embodiments comprises at least two aspects played essentially simultaneously or in parallel, such that a single given event instances causes a first result (which may in some embodiments comprise a plurality of first results) to be determined for a first aspect of the game and a second result to be determined for a second aspect of the game. Determining a result (for either a first aspect or a second aspect of the game) may, in some embodiments, comprise determining an outcome representing the result (e.g., determining the particular symbols and/or location of symbols to display to represent the result). A result for a first aspect of a game is referred to as a first result herein and a result for a second aspect of the game is referred to as a second result herein. Similarly, an outcome for a first result or first aspect of a game is referred to as a first outcome herein and an outcome for a second result or a second aspect of the game is referred to as a second outcome herein.

In some embodiments, a first outcome may be related to a second outcome. For example, in some embodiments (e.g., such as the embodiment illustrated in FIGS. 7A-7G) a first outcome may contribute to a session result, which is provided to a player at the end of a session if a pre-requisite condition is satisfied and an end of a session and/or whether the pre-requisite condition is satisfied may be determined based on one or more second outcomes.

At least one aspect of the game is played such that the results determined for the event instances during a given session contribute, for that aspect of the game, to a session result determined at the end of the session. In some embodiments, a result for an event instance may be a negative result such that it negatively impacts a player's progress in the game. In some embodiments, a single event instance causes (i) one or more of the first outcome(s) and/or result(s) to be determined by accessing a first probability table corresponding to a first aspect of the game and (ii) one or more of the second outcome(s) and/or result(s) to be determined by accessing a second probability table corresponding to a second aspect of the game. Again, both the first outcome(s) and first result(s) and the second outcome(s) and first result(s) are determined upon a single triggering event or event instance and are thus considered to be outcomes and results for a single event instance of the game. For example, both the first result(s) and the second result(s) may be determined based on the same single initiation input from a player of the game (e.g., upon the player actuating a "start" or "spin" mechanism of the game).

In one embodiment, the outcome for a first aspect of the game is represented by a combination of symbols from a first set of symbols (e.g., the outcome for a given event instance is a subset of symbols of the available symbols, selected based on a random number determined for the event instance) and the result for the second aspect of the game is represented by one or more symbols of a second set of symbols (which second set of symbols may comprise only one type of symbol in some embodiments). Further, in some embodiments the result for a second aspect of the game is displayed in a manner such that it is overlaid onto the result of the first aspect of the game or otherwise conceals or obscures at least a portion of the result for the first aspect of the game, such that the result of the first aspect of the game is not immediately discernible to a player. The symbol(s) representing the result for the second aspect of the game may, after a predetermined period of time (e.g., one or two seconds) be moved or removed such that they no longer overlay or conceal the result of the first aspect of the game and the player can thus discern both the result of the first aspect of the game and the result of the second aspect of the game. This may be thought of as a "two-stage" reveal of results for a given event instance. One example embodiment of such a "two-stage" reveal methodology for displaying both results for a given event instance is illustrated in the screen shots of FIGS. 7A-7G, which are described in detail below.

In one illustrative and non-limiting embodiment (illustrated in detail in FIGS. 7A-7G, which are described in more detail below), the game may be embodied as one in which the first aspect of the game comprises a reel spin game having a plurality (e.g., four) of sets of reels, each set of reels corresponding to a different character of the game. The sets of reels may be displayed in a first interface, frame or portion of a screen or display. Each character may, for example, be represented as a distinct graphic such as a cartoon-like animal, creature or other form. For a given event instance, each set of reels is spun and stopped to reveal a particular outcome corresponding to a result (which result may comprise an award due to the player as a result of the spin. Thus, in the present example embodiment in which a plurality of sets of reels are spun for a given event instance, each spin result for a given set of reels corresponds to a result of a first aspect of the game, which result determination is triggered by a given event instance. In this example embodiment, a second aspect of the game may comprise a contest or race in which each character, in addition to having associated with it a set of reels, is represented in a second interface, frame or portion of the screen or display in which each character respectively attempts to successfully maneuver from a start position to a finish position prior to the occurrence of an end event. The end event may be an end event corresponding to a specific character (such that a first character's attempt to win the race or contest may be ended by a first end event while a second character's attempt to win the race or contest may be ended by a second end event) or may be an end event which ends the attempts for all the characters (e.g., a timer runs out and ends the race for all characters). In one example embodiment, an end event may comprise a character's movement resulting in the character being behind the start position of the race or contest. In another example, an end event may comprise a character successfully moving onto or past a finish position of the race or contest.

In accordance with some embodiments, a game having a plurality of aspects as described herein comprises a bonus game played in a bonus feature of a primary game. In other embodiments, the game having the plurality of aspects may be the primary game.

In accordance with some embodiments, apparatus, systems, articles of manufacture and methods described herein provide for populating a plurality of game symbol positions with primary game symbols affecting a first aspect of a game such that a single primary game symbol is placed in each game symbol position; overlaying, on at least one randomly selected game symbol position, a respective special symbol affecting a second aspect of the game such that the respective special symbol hides from view the primary game symbol in the randomly selected game symbol position on which it is overlaid; outputting a first game interface to a player which shows the game symbol positions as populated with the placed primary game symbols and overlaid with the special symbol(s), thereby outputting a second result of the second aspect of the game; evaluating the second aspect of the game based on the special symbol(s); modifying the first game interface to reveal the primary game symbol(s) previously hidden from view by the special game symbol(s), thereby revealing first result of the first aspect of the game; and evaluating the first aspect of the game based on the placed primary game symbols. In some embodiments, modifying the first game interface may comprise removing the special symbol(s) from the symbol positions. In some embodiments, modifying the first game interface may comprise moving the special symbol(s) from the symbol positions to a second interface corresponding to the second aspect of the game. In some embodiments, the game may comprise a wagering game and evaluating the first aspect of the game may comprise awarding an appropriate number of credits to a player associated with the game based on the first result.

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

B. Definitions

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a personal computer online in web browsers, on a game console and/or on a mobile device such as a smart-phone or tablet computer. "Gaming" thus refers to play of a game.

A "casual game", as the term is used herein unless specified otherwise, may comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as used herein unless specified otherwise, refers to a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but can also be implemented on other platforms such as mobile devices.

A "wagering game", as the term is used herein, may comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" refers to play of a wagering game.

The term "game provider", as used herein unless specified otherwise, refers to an entity or system of components which provides games for play and facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate a gambling website over which wagers are accepted and results of wagering games are provided.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

C. General Systems and Structure

FIG. 1 depicts a block diagram of an example system 100 according to some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions. Instructions may be embodied in, e.g., one or more computer programs and/or one or more scripts.

In some embodiments a game server 110 and/or one or more of the player devices 102 stores and/or has access to data useful for facilitating play of a game. For example, game server 110 and/or a player device 102 may store (i) one or more probability databases for determining one or more outcome(s) for an event instance or turn of a game, (ii) a current state or status of a game or game session, (iii) one or more user interfaces for use in a game, (iv) one or more game themes for a game and/or (v) profiles or other personal information associated with a player of a game. It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player, determining an outcome for a game, causing an outcome of a game to be displayed on a player device, facilitating a wager and/or a provision of a payout for a game). For example, the game server 110 may comprise a server computer operated by a game provider or another entity (e.g., a social network website not primarily directed at providing games). In some embodiments, the game server may determine an outcome for a first aspect and/or second aspect of a game by requesting and receiving such an outcome from another remote server operable to provide such outcomes. In some embodiments, the game server 110 may further be operable to facilitate a game program for a game (e.g., a wagering game). In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc). In some embodiments, game server 110 may comprise two or more server computers operated by the same entity (e.g., one server being primarily for storing states of games in progress and another server being primarily for storing mechanisms for determining outcomes of games, such as a random number generator). Examples of processes that may be performed by the game server 110 (directly or indirectly) may include, but are not limited to: (i) determining a movement direction (e.g., advance or fall back) and/or an extent or amount of movement (e.g., a number of predetermined spaces or units of movement along a grid, axis or path) of a game element or game character; (ii) determining which probability table(s) or section(s) of a probability table to utilize for a particular event instance; (iii) determining a first outcome and a second outcome for a particular game instance; (iv) transmitting an indication of a first outcome and a second outcome to a player device; (v) authorizing a game program to be downloaded to a player device; and/or (vi) modifying (or directing a player device to modify) a game interface which is outputting a first outcome such that a second outcome of the game instance becomes discernible to an associated player.

Turning now to a description of a player device 102, in accordance with some embodiments a player device 102 may comprise a computing device that is operable to execute or facilitate the execution of a game program and used or useful by an online player for accessing an online casino or other electronic (e.g., online) game provider. For example, a player device 102 may comprise a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox 360™, Sony™ Plasystation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine) or a non-dedicated gaming device (e.g., an iPad™). It should be noted that a game server 110 may be in communication with a variety of different types of player devices 102.

A player device 102 may be used to play a wagering or non-wagering game (e.g., a social or casual game) over a network and output information relating to the game to players participating in the game (e.g., outcomes for an event instance of the game, qualifying for a bonus round of the game, credit balance of credits available for play of the game, a session result for a session of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that an event instance has been triggered or initiated (and, in some embodiments, communicating such a trigger or initiation to game server 110), (ii) a first outcome for a first aspect of the game and a second outcome for a second aspect of the game; (iii) a first result and/or a second result, and/or (iv) determining a session result. In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110. It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102.

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

Figure 2:
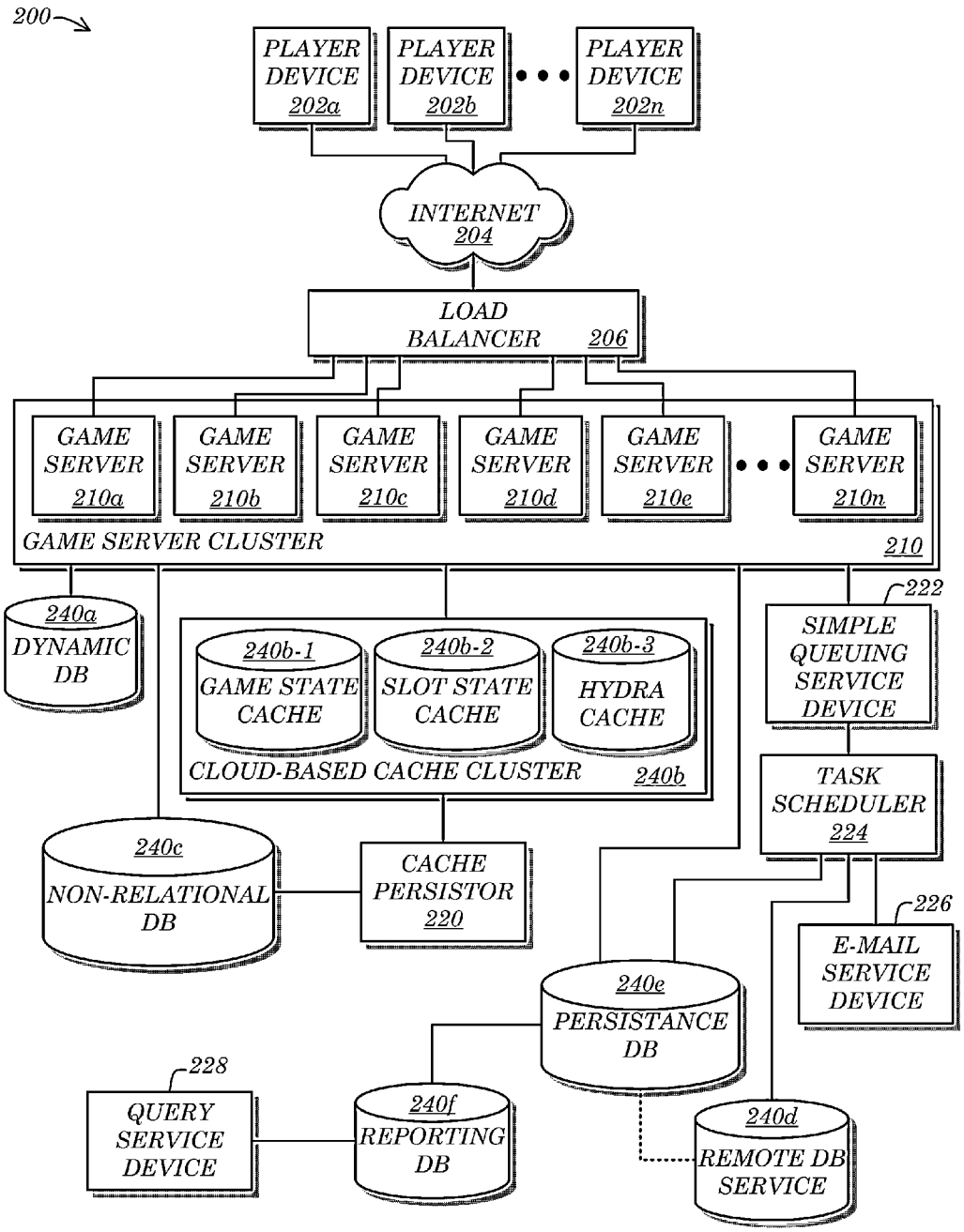
FIG. 2 is a schematic diagram of an embodiment of a social gaming platform in accordance with one or more embodiments described herein.

FIG. 2 a block diagram of a system 200 according to some embodiments is shown. In some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player device 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof. In some embodiments, the various game servers 210*a-n* (virtual and/or physical) of the game server cluster 210 may be configured to provide, manage, host, and/or conduct individual instances of available game types. A first game server 210*a*, for example, may host a first particular instance of an online bingo game (or tournament), a second game server 210*c* may host a second particular instance of an online bingo game (or tournament), a third game server 210*c* may facilitate an online poker tournament, and/or a fourth game server 210*d* may provide an online slots game.

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer. In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/stickiness). In some embodiments, the load balancer 206 may comprise one or more devices and/or services provided by a third-party (not shown). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for specific game types such as a game including two aspects as described herein, the game server cluster 210 may provide game outcomes (such as a first outcome for a first aspect of a game or a second outcome for a second aspect of a game) to a controller device (not separately shown in FIG. 2) that times the release of game outcome information to the player devices 202*a-n* such as by utilizing a broadcaster device (also not separately shown in FIG. 2) that transmits the time-released game outcomes to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DyanmoDB™ service provided by Amazon® Web Services, LLC. The dynamic DB 240*a* may, for example, store information specific to one or more certain game types (e.g., a reeled slots themed game) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistior 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve spin and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
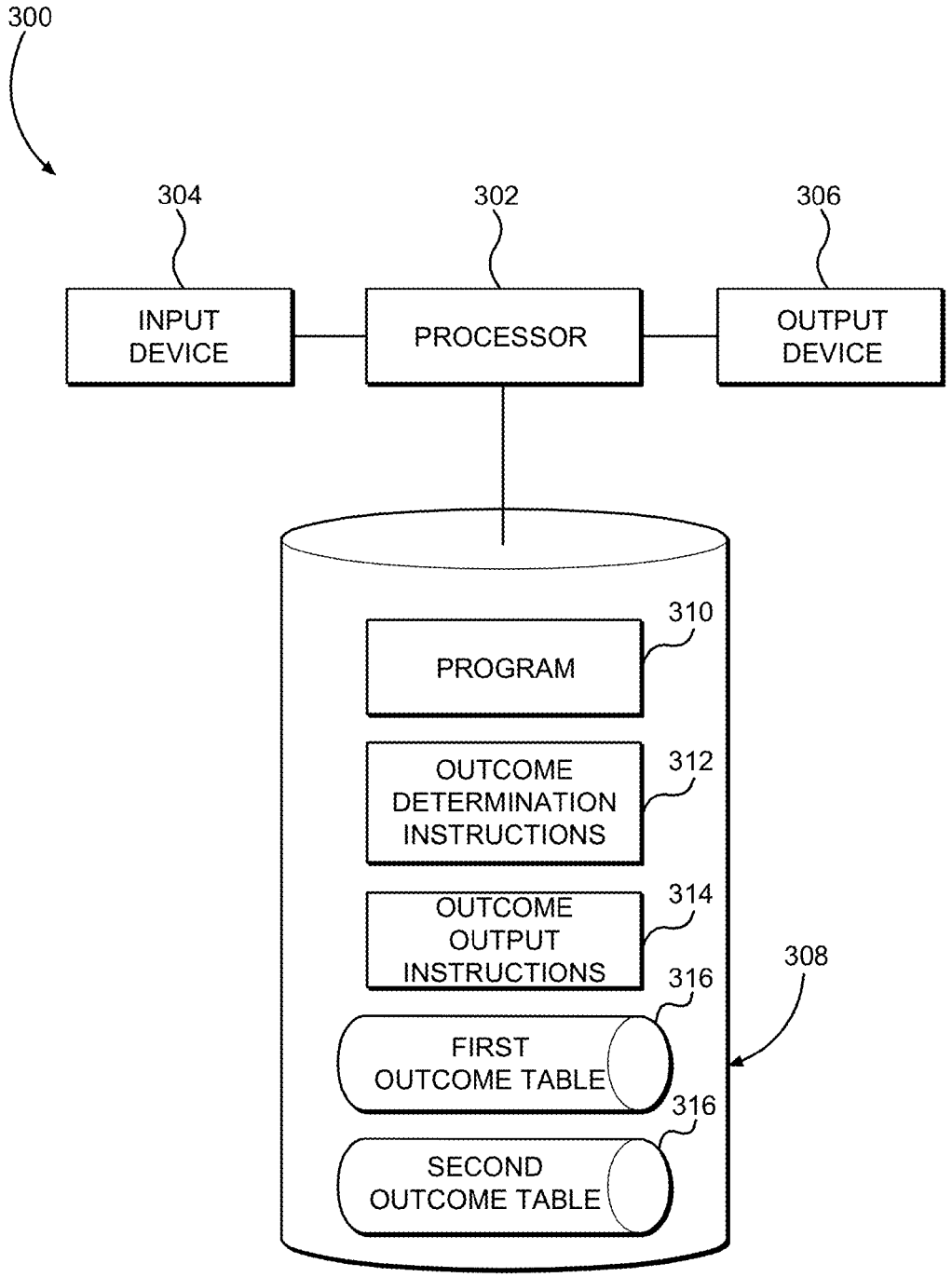
FIG. 3 is a block diagram of an embodiment of a computing device useful in a system according to one or more embodiments described herein.

FIG. 3 is a block diagram of an apparatus 300 according to some embodiments. In some embodiments, the apparatus 300 may be similar in configuration and/or functionality to any of the player devices 102, the game server 110 and/or another server device operable to facilitate the embodiments described herein. The apparatus 300 may, for example, execute, process, facilitate, and/or otherwise be associated with any of the processes 500 and/or 600 described herein in conjunction with FIG. 5 and FIG. 6, respectively.

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple inter-connected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, a keyboard that allows an operator of the apparatus 300 to interface with the apparatus 200 (e.g., by a player, an employee or other worker affiliated with either an online casino or other entity operating a system which provides games to players). In some embodiments, the input device 304 may comprise a mechanism configured to indicate to a remote server device an initiation or triggering of an event instance (e.g., that a player has actuated a "reel spin" mechanism and thus initiated a new spin of a reels-based game), such information being provided to the apparatus 300 and/or the processor 302. In such embodiments, the input device may comprise a key on a keyboard of the apparatus 300. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a touch-screen, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

The output device 306 may, according to some embodiments, comprise a display screen and/or other practicable output component and/or device that is operable to output information. The output device 306 may, for example, comprise a display screen via which are output instructions, guidance, questions or information to a player of an online game (e.g., a first outcome and a second outcome of a given event instance). Some additional examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen monitor.

In some embodiments, the apparatus 300 may comprise any type or configuration of communication device (not shown) that is or becomes known or practicable. For example, the apparatus 300 may include a communication device such as a NIC, a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., an initiation of an event instance) to a server (e.g., game server 110) in communication with a plurality of player devices 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include one or more of outcome determination instructions 312 and/or one or more outcome output instructions 314. In some embodiments, the outcome determination instructions 312 and/or the outcome output instructions 314 may be utilized by the processor 302 to provide output information via the output device 306. The outcome determination instructions 312 may, for example, provide instructions (i) for determining when to determine a first outcome and a second outcome for an event instance in a game, (ii) to use a first specified probability table to determine a first outcome for a first aspect of the game and to use a second specified probability table to determine a second outcome for a second aspect of the game, and/or (iii) to direct one or more other server devices to determine both a first outcome for a first instance of a game and a second outcome for a second instance of the game for a given event instance (wherein the first outcome may be requested from a first server device while the second outcome may be requested from a second server device). The outcome output instructions 314 may, for example, provide instructions for (i) placement of symbols to represent a second outcome for a second aspect of the game; (ii) timing for when to reveal the first outcome of the game once the first outcome of the game has been revealed to an associated player; (iii) modifying a game interface to reveal the first outcome after the second outcome has been displayed.

The memory device 308 may further store one or more outcome databases, such as a first outcome table 316 and a second outcome table 318. A first outcome table 316 may comprise, for example, one or more tables for determining an outcome for a first aspect of a game while a second outcome table 318 may comprise one or more tables for determining an outcome for a second aspect of the game. As described herein, in some embodiments a single event instance of a game may cause a computing device (e.g., a game server 110) to determine two types of outcomes for the event instance (one outcome for a first aspect of the game and a second outcome for a second aspect of the game) and thus, in one embodiment, access two different outcome tables, servers, programs and/or instructions (a different one for each respective type of outcome).

The apparatus 300 may function as a computer terminal and/or server of an online casino or other entity operating to provide online games, receive and/or manage information related to online games. In some embodiments, the apparatus 300 may comprise a web server and/or other server device operable to accept wagers and determine random numbers based upon which outcomes for wagering games are determined. In some embodiments, the apparatus 300 may comprise an apparatus that is operable to interact with a player of an online game.

Any or all of the exemplary instructions and data types described herein and other practicable types of data may be stored in any number, type, and/or configuration of memory devices that is or becomes known. The memory device 308 may, for example, comprise one or more data tables or files, databases, table spaces, registers, and/or other storage structures. In some embodiments, multiple databases and/or storage structures (and/or multiple memory devices 308) may be utilized to store information associated with the apparatus 300. According to some embodiments, the memory device 308 may be incorporated into and/or otherwise coupled to the apparatus 300 (e.g., as shown) or may simply be accessible to the apparatus 200 (e.g., externally located and/or situated).

D. Databases

Referring to FIG. 4, a schematic illustration of an exemplary data structure 400 according to some embodiments is shown. In some embodiments, the exemplary data structure 400 may comprise a tabular representation illustrating example records of the second outcome table 318. As described herein, in one embodiment a second aspect of a game may comprise a session-type game in which one or more game characters moves along a pathway or other interface from a start position to a finish position with the goal being for the game character to reach the finish position prior to an end event. In some embodiments, a player associated with the game may qualify for a prize or award if a game character in the game reaches the end position prior to the end event. The second outcome table embodied in data structure 400 may be utilized, in accordance with some embodiments, to determine the movement of a game character throughout a session of the game. Thus, the data structure 400 may be utilized to determine one or more second outcomes for a second aspect of a game. For example, the data structure 400 may be accessed for each event instance of a game to determine the magnitude and direction of movement for a particular game character. In embodiments in which a plurality of game characters are represented in the game (e.g., a plurality of characters are racing or otherwise competing), the data structure 400 may be accessed once for each game character for a given event instance such that the data structure 400 is accessed to determine multiple second outcomes (one for each game character) for a given event instance.

It should be understood that other tables, data or instructions may be utilized to determine a second outcome, in addition or in lieu of the data structure 400. For example, in one embodiment, in addition to determining the magnitude (e.g., how many spaces) and direction (e.g., backwards or forwards) of a game character, the determination of a second outcome for a second aspect of a game may comprise (i) determining a random number for use in determining whether a special symbol is to be part of the second outcome, and/or (ii) determining a symbol position on which the special symbol is to be placed (e.g., a symbol position of a plurality of possible symbol positions associated with the game character may be selected in a random fashion if it is previously determined that the special symbol should in fact appear as part of the second outcome for a particular turn of the session).

The exemplary data structure 400 that is representative of the records of one embodiment of the second outcome table 318 includes a number of entries, each of which defines movement and probability data related to the movement of a game character and the probability of the appearance of a special symbol on a symbol position of a game interface of the game. Those skilled in the art will understand that the second outcome table 318 may include any number of entries. Those skilled in the art will further understand that many different and/or additional fields and/or types of data may be stored in the second outcome table 318 other than those illustrated as exemplary and non-limiting.

The exemplary data structure 400 of the second outcome table 318 defines a number of records R405, R410, R415 and R420, each record defining movement rules to be applied to a game character during a corresponding turn in a session. For example, record R405 defines movement rules to be applied to a game character during the first three (3) turns of a session, record R410 defines movement rules to be applied to a game character during the next seven (7) turns of the session and so on. Of course, any number of records and turn ranges may be utilized and in some embodiments a range of turns may consist of a single turn (e.g., a special movement rule may be applied for turn X of a session).

The exemplary data structure 400 further defines the following fields for each record: (i) a session turn field 402, which indicates a turn, or range of turns, within a session pertinent to a given record; (ii) a movements back field 404 which indicates a number of movements or positions backwards that an associated game character is to take along a game pathway for the associated turn, or turn within the associated range of turns; and (iii) a probability of obtaining a special symbol during the associated turn, or turn within the associated range of turns (the appearance of the special symbol affecting the movement of the game character in accordance with some embodiments). Thus, a program accessing data structure 400 as part of determining a second outcome for a second aspect of a game may first determine which turn in a session the second outcome is being determined for, in order to identify which record of the data structure 400 to look to for the appropriate movement rule. For example, if the turn is turn five (5), then record R410 may be accessed while if the turn is turn fourteen (14), then record R415 may be accessed.

With respect to the special symbol probability field 406, it should be noted that the probability of a special symbol appearing as part of a second outcome may be expressed, stored and/or determined in a variety of manners. For example, the field 406 illustrates a probability as a number. This number may, in some embodiments, represent a probability of a special symbol appearing but this field (or another field) may also serve as an indicator, identifier or pointer to a more detailed table (e.g., probability table), probability algorithm or other outcome determination scheme for determining random numbers or other outcomes for use in determining whether a special symbol is to appear for a given turn. Thus, if it is determined that the current turn of a session is a thirteenth ($13^{th}$) turn, it may be determined that Record R415 is to be utilized to determine the second outcome for the current event instance and that the probability of a special symbol appearing as part of the second outcome is 0.1%. In some embodiments, Record R415 may then further indicate that a particular probability table is to be used to determine whether a special symbol is to appear as part of the second outcome, the particular probability table storing data which results in a 0.1% chance of the special symbol appearing as part of the second outcome. In another embodiment, Record R415 may store a pathway or identifier of a server or random number algorithm to be accessed or utilized in order to determine whether a special symbol is to appear as part of the second outcome for the present event instance, which server or random number utilizes the 0.1% probability result in determining the special symbol.

In other embodiments the data structure 400 may store a plurality of ranges of random numbers for each record R405-R420. For example, in one such embodiment a table of possible random number ranges may be accessed when a particular random number is determined for use for a particular turn, in order to identify which random number range the determine random number falls within and the special symbol outcome associated with that range (e.g., the random number range scheme may be a binary one, with some random number ranges corresponding to a "yes—special symbol appears for game character" or "no—special symbol does not appear for game character). In some embodiments, an outcome scheme may allow for more than one special symbol may appear for a given game character in a particular turn. A person of ordinary skill in the art would understand various data structures or other programs for effectuating a determination of a second outcome in such embodiments after reading the present disclosure.

In accordance with one example embodiment, an appearance of the special symbol on particular game symbol position (e.g., a reel position of a reel set) associated with a particular game character has a specific effect on the movement of the game character along a game pathway or other interface. For example, the appearance of the special symbol may cause the game character to move forward X number of spaces along the game interface (e.g., towards a finish position). In one embodiment, a game character may only move forward if the special game symbol appears on a game symbol position associated with the character. In another embodiment, a game character may move forward in accordance with a default movement scheme (e.g., one movement forward for each turn of the game in which a backwards movement rule is not applied to the game character) but the appearance of the special symbol on a symbol position associated with the game character may cause the game character to move forward an extra number of spaces (e.g., the special symbol causes the game character to speed up or jump ahead in the game interface, outside or beyond the default movement rate or scheme otherwise guiding the movement of the character).

It should be noted that in some embodiments, the data in movements back field 404 is utilized only if it is determined that a special symbol is not to be appear as part of the second outcome for the given event instance or turn of the game. Thus, for example, if the current turn is the fifth ($5^{th}$) turn and it is determined that a special symbol is to appear as part of the second outcome for the turn, the two (2) movements back may not be applied to the game character for the turn and only the effects of the appearance of the special symbol may be applied (e.g., one (1) movement forward).

As should be evident from a review of the example data illustrated in data structure 400, one movement strategy which may be applied results in a game character not being moved backwards (further away from the finish position and back towards the start position or prior to the start position to an "out of the game" area) in the beginning part of the session (such as the first three (3) turns of the session) and then the game character being moved back by more and more movements per turn as session advances. With respect to the special symbol appearance as part of a second outcome, the example strategy illustrates that the probability of appearance of the special symbol may gradually increase and peak after several turns in the session, then be decreased as the session progresses. It should be noted that a wide variety of different types of movement mechanics and schemes may be utilized to move a game character along a game pathway and a wide variety of strategies for affecting the movement of the game character during a session may be implemented. The game character movement strategy evident in the data illustrated in table 400 is exemplary only and should not be interpreted in a limiting manner.

E. Processes

Figure 5:
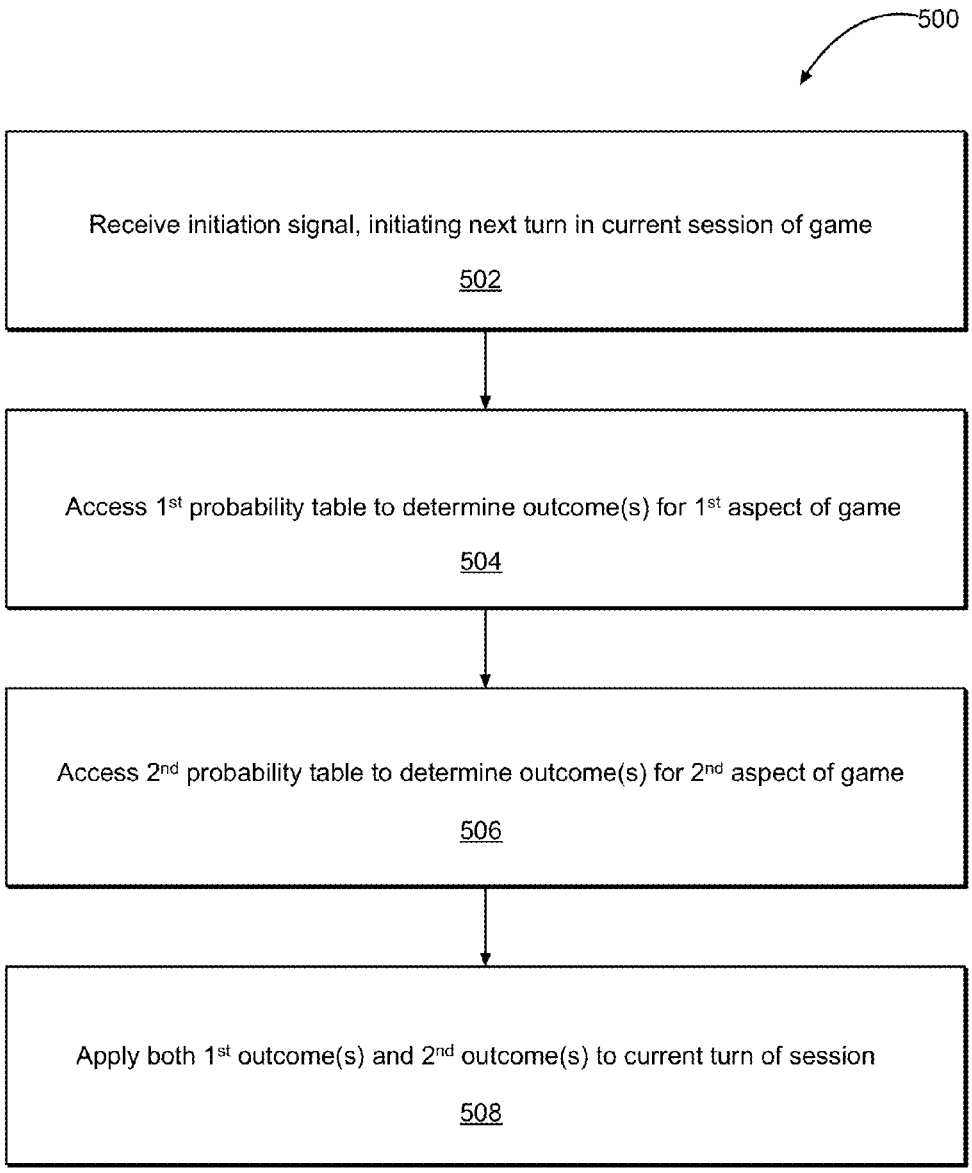
FIG. 5 is a flowchart illustrating a method according to one or more embodiments described herein.

Referring now to FIG. 5, a flow diagram of a method 500 consistent with some embodiments is shown. The process 500 comprises a process for determining two distinct types of outcomes for a single event instance of a game: a first outcome for a first aspect of the game and a second outcome for a second aspect of the game. The process 500 may, for example, be performed by or on behalf of a game provider. For purposes of brevity, the process 500 will be described herein as being performed by a game server 110 of FIG. 1. However, in other embodiments some or all of the steps may be performed by another device (e.g., a game server 210 or any of the devices or databases it is in communication with, as described with respect system 200 of FIG. 2; or player device 102 of FIG. 1). It should further be noted that while all of the steps described with respect to process 500 may be performed by a single device, in some embodiments different steps may be performed by different devices. Further still, any steps described herein as being performed by a particular computing device may be performed by a human or another computing device as appropriate.

According to some embodiments, the process 500 may begin with receiving an initiation signal (e.g., from a player or player device), the signal for initiating a next turn in a current session of a game. For example, the signal may comprise a request for initiating the next event instance of a game, such that the game may progress and outcomes for the event instance may be determined. In one embodiment in which at least one aspect of the game comprises a reel-based slot themed game, receiving the initiation signal may comprise determining or recognizing that a player has actuated a "spin" mechanism associated with the virtual reels of the game.

In step 504, a first probability table (e.g., first outcome table 316) is accessed (directly or indirectly by the device performing the process 500) to determine one or more first outcome(s) for a first aspect of the game. For example, a traditional probability table which stores ranges of random numbers to particular respective outcomes may be accessed. The probability table may be stored on the same device as is performing process 500 or, in some embodiments, may be stored in a memory of another (e.g., remote) server device. Thus, for example, step 504 may comprise transmitting a request for the one or more first outcome(s) to another device.

In some embodiments, step 504 may further comprise first determining a random number (e.g., one random number for each first outcome to be determined) and utilizing the random number to identify the corresponding first outcome based on the data stored in a first probability table. For example, the device performing process 500 may transmit a request for a random number to a server device operable to generate and/or transmit such random numbers. In another embodiment, the device performing step 504 may include an internal random number generator and step 504 may comprise determining a random number by use of the internal random number generator.

Once a random number is determined, the determined random number may be used to access the first probability table in order to determine a first outcome corresponding to the random number. In one embodiment, the device performing step 504 receives the random number(s) from another first device and transmits it to another second device which has stored thereon the first probability table, thereby receiving the first outcome from the second device.

In step 506, a second probability table is accessed (directly or indirectly by the device performing the process 500) to determine one or more second outcome(s) for a second aspect of the game, still for the same turn or event instance of the game initiated in step 502. For example, a second outcome table 318 (of FIG. 3) may be accessed. In another example, a table such as that depicted in data structure 400 (of FIG. 4) may be accessed. As described with respect to step 504, step 506 may further comprise first determining a random number (one random number for each second outcome to be determined for the second aspect of the game). Thus, step 506 may comprise determining the random number directly (e.g., by use of an internal random number generator) or receiving it from another device and then using the random number (directly or by cooperation with another device) to determine the second outcome corresponding to the random number in the second probability table.

In one embodiment, as described with respect FIG. 4, determining a second outcome(s) for a second aspect of the game may further comprise determining which turn of the session the second outcome(s) is being determined for. Thus, step 506 may in some embodiments comprise determining (e.g., by accessing a running count of turns for a current session) which turn the current turn is. For example, assuming the data structure 400 is being utilized and the current turn is the sixth ($6^{th}$) turn in the session, record R410 may be determined to be the appropriate record of the second outcome table to use. In some embodiments, as also described with respect to FIG. 4, determining which turn it is or which record of the second outcome table to use may be a prerequisite to determining which probability algorithm, probability table or random number generator to access to determine a second outcome for a second aspect of the game. Thus, step 506 may comprise accessing a plurality of tables, data, database or records in order to determine a second outcome for the event instance initiated in step 502. In some embodiments in which the second aspect of the game comprise a contest or race engaged in by game characters moving along a pathway or interface of the game, determining a second outcome(s) for the game may comprise a direction and magnitude of movement for the game character(s).

Once both the first outcome(s) and the second outcome(s) are determined for the turn or event instance initiated in step 502, each of the first outcome(s) and the second outcome(s) is applied to the turn. This may comprise, for example, (i) causing both the first outcome and the second outcome to be revealed to the player associated with the current session or turn, (ii) adding or subtracting credits from a credit meter of the player (e.g., as a result of the first outcome(s), if the game is a game playable for credits) and/or (iii) moving one or more game character(s) along a pathway or interface of the game (e.g., in accordance with the direction and magnitude comprising the second outcome(s). In some embodiments, causing both the first and second outcome to be revealed to the player may be done in a particular order, such as the two-stage reveal process illustrated with respect to FIGS. 7A-7G.

Figure 6:
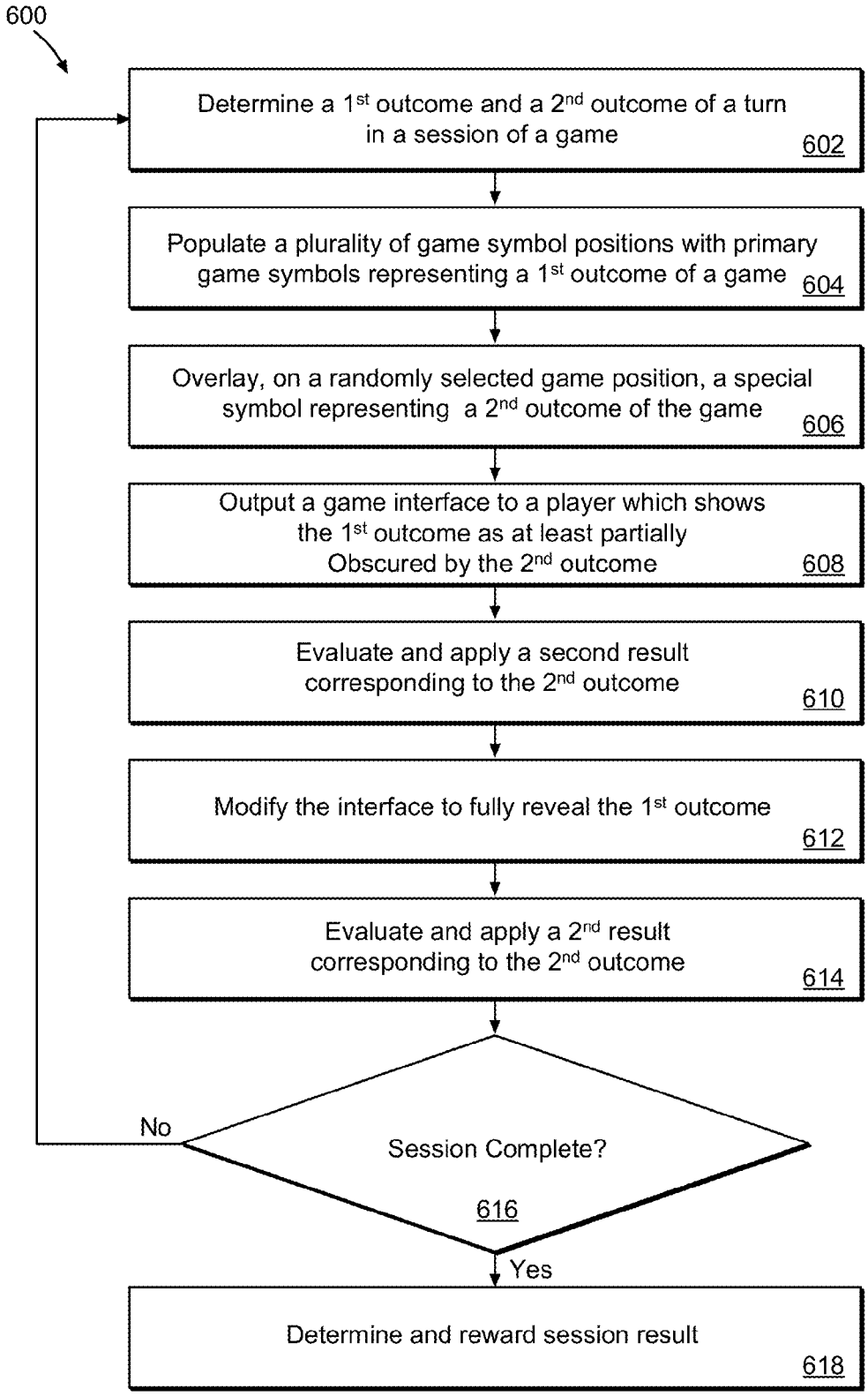
FIG. 6 is a flowchart illustrating a method according to one or more embodiments described herein.

Referring now to FIG. 6, illustrated therein is a process 600 for outputting and applying a first outcome and a second outcome for a given event instance of a game, in accordance with some embodiments described herein. In the illustrative embodiment of process 600, a first aspect of a game comprises a reels-based game having a plurality of game symbol positions for a primary type of game symbol and a second aspect of the game comprises temporarily overlaying a special symbol on at least one of the symbol positions such that it obscures the primary symbol of that position, thereby employing a two-stage reveal process for revealing the second outcome and then the second outcome of a given turn or event instance to a player.

The process 600 may, for example, be performed by or on behalf of a game provider. For purposes of brevity, the process 600 will be described herein as being performed by a game server 110 of FIG. 1. However, in other embodiments some or all of the steps may be performed by another device (e.g., a game server 210 or any of the devices or databases it is in communication with, as described with respect system 200 of FIG. 2; or player device 102 of FIG. 1). It should further be noted that while all of the steps described with respect to process 600 may be performed by a single device, in some embodiments different steps may be performed by different devices. Further still, any steps described herein as being performed by a particular computing device may be performed by a human or another computing device as appropriate.

In accordance with one embodiment, process 600 may begin with determining a first outcome and a second outcome for a particular turn or event instance in a session of a game (step 602). For example, a first outcome and a second outcome may be determined in accordance with process 500 or another process which facilitates the determining of two distinct outcomes for two distinct aspects of a game which progress in parallel or essentially in parallel over the course of a session of a game.

In accordance with some embodiments, the first outcome may be represented by a plurality of primary game symbols (which may have been determined in step 602, for example only, by determining a random number and determining the combination of primary game symbols to represent an outcome corresponding to that random number). Thus, step 604 comprises populating a plurality of game symbol positions (e.g., on a set of virtual reels or matrix) with the plurality of primary game symbols. In one embodiment, a single primary game symbol is placed in each respective game symbol position. For example, if the first outcome is a winning outcome step 604 may comprise placing certain symbols representing the winning outcome along a payline of the game and populating the remainder of symbol positions with random outcomes which do not represent a winning outcome. If the first outcome determined in step 602 is not a winning outcome, step 604 may comprise populating the symbol positions such that no winning outcome is placed along a payline of the game.

In step 606 the one or more special symbols comprising the second outcome is overlaid onto the symbol positions on which the primary game symbols were placed. In one embodiment, only one special symbol is placed on any given symbol position. In one embodiment, determining the second outcome in step 602 may have included determining which particular symbol position to place the special symbol on. In another embodiment, determining the second outcome may comprise determining a number of special symbols (or whether a special symbol should be placed at all) and a particular symbol position may be determined at random in step 606 or another step (e.g., the particular symbol position on which the special symbol is placed may be unimportant in some embodiments). In some embodiments, the special symbol may be placed at random but in a symbol position on which a primary game symbol representing a winning outcome has been placed or along a payline. In some embodiments, the placement of the special symbol on a symbol position obscures the primary game symbol previously placed in this position, thus so long as the special symbol is in the symbol position the primary game symbol is not visible or discernible to the player. Thus, placement of the special symbol may, in some embodiments, be selected such as to prolong the anticipation of the player in determining whether the first outcome represented by the primary game symbols is a winning symbol.

It should be noted that steps 602-606 may be a background steps, such that the player associated with the game is not aware of the first and second outcomes, placement of the primary game symbols or placement of the special symbol (or whether a special symbol is part of the second outcome at all) at this stage of the process. For example, the player may see reels spinning in a reels-based game and steps 602-606 may be performed as a background process such that neither the first outcome or the second outcome is discernible or visible to the player until one or both of these outcomes is output in step 608.

In step 608 a game interface is output to the player associated with the game, the game interface showing the first outcome as partially obscured by the special symbol(s) comprising the second outcome. For example, in a reels-based game, the reels may be stopped to reveal the placement in the symbol positions in conformance with steps 604 and 606 (whereby at least one of the primary game symbols comprising the first outcome is obscured by a special symbol). Thus, the player may be able to view and determine a result of the second outcome (e.g., whether any special symbols were earned or won for the present event instance) but not the first outcome.

In step 610, the second outcome is evaluated to determine a second result of a second aspect of the game and is applied to the second aspect of the game. In other words, a second aspect of a game is progressed, modified or advanced based on the second outcome. This progression, modification and/or advancement may be reflected via a modification of a display area or interface corresponding to the second aspect of the game (e.g., game elements may be moved, rearranged or modified based on the second outcome, credits in a credit meter or other points may be adjusted, etc. In one embodiment in which the second outcome comprises a presence of a special symbol, any effect of a special symbol being included as part of the second outcome may be applied to the second aspect of the game. For example, if the appearance of the special symbol advances movement of a game character by a certain magnitude and a certain direction, that game character may be moved in the appropriate direction and by the appropriate magnitude. Thus, the second outcome is the special symbol. The second result is the movement of the game character in the appropriate direction and by the appropriate magnitude. Of course, other results which comprise advancing a player's progress in a second aspect of a game based on the second outcome are within the scope of the embodiments described herein.

In step 612 an interface of the game is modified to fully reveal the first outcome. Thus, for example, the special symbol(s) comprising the second outcome (which were overlaid onto one or more primary game symbols in symbol positions comprising the interface) may be removed from the game symbol positions such that the primary game symbol(s) in the positions occupied by the special symbol(s) are now visible or discernible to the associated player. This step may be thought of as the second stage of revealing the results for a given event instance or turn of a game (the first stage having been the display or revealing of the second outcome in step 608).

In step 614 the first outcome is evaluated and a first result corresponding to the first outcome is applied to a first aspect of the game. For example, any points, rewards or credits corresponding to the first outcome may be added to a meter (e.g., a point, reward or credit meter) of the game or another prize may be awarded to the player (e.g., a free spin, a free drink, a reduction in a price or wager for future plays of a game, etc.).

In step 616 it is determined whether the session currently underway has been completed. For example, it may be determined whether an end event corresponding to an ending of the session has been reached or achieved. In some embodiments, the session may end upon a predetermined number of turns or a predetermined amount of time passing from a beginning of the session. In such embodiments, step 616 may comprise determining whether the predetermined number of turns or the predetermined amount of time has passed. In another example embodiment, a session may end when a game character reaches a predetermined state (e.g., successfully finishes a race or contest, is disqualified from the race or contest, earns a predetermined qualification, characteristic or other award, etc.). As described herein, at least a second aspect of a game may comprise a session in which the second outcomes of the event instances during a session contribute to a session result which is determined at the end of the session. Thus, if it is determined in step 616 that the session is complete, the process 600 proceeds to step 618, in which step a session result is determined. If the session is not complete, the process 600 returns to step 602, in which step the first outcome and the second outcome for the next event instance in the session is determined.

Determining a session result (in step 618) may comprise evaluating the second results earned during the session. For example, if the second results each correspond to a certain number of points, credits, free spins or other awards, step 618 may comprise summing the points, credits, free spins or other awards. In another embodiment, there may be a predetermined threshold of points, credits, free spins or other awards that need to be earned during the session in order to qualify for a meta-award. In such an embodiment, step 618 may comprise determining whether the threshold has been satisfied and thus whether the meta-award should be awarded to the associated player. Examples of meta-awards include, for example, additional credits, points or free spins, tickets to events, advancement to a higher level of a game, skills or assets available to the player (or a game character) of the game, display of the player's name on a leader board, etc.

F. Example Screen Shots of Illustrative Game

FIGS. 7A-7G illustrate one example and non-limiting game which is consistent with some embodiments described herein. It should be noted that all features of the game illustrated in FIGS. 7A-7G are non-limiting (e.g., any number of game characters or reel sets may be used, treadmill theme is merely for illustrative purposes). The game illustrated in FIGS. 7A-7G comprises a first aspect consisting of four sets of reels: reel set 710, reel set 720, reel set 730 and reel set 740. Each of the reel sets has displayed at the bottom a "finish bonus" which may be a number of credits, points, free spins or other awards earned by the character. During a given session, each set of reels is spun for each event instance or turn of the session. If an outcome (each outcome of each reel set being considered a respective first outcome) is a winning outcome, the appropriate number credits, points, free spins or other awards is added to the "finish bonus" for the associated reel set. Each of the reel sets correspond to a respective game character 712, 722, 732 and 742, the game characters being displayed as being on a treadmill 750. The movement of the game characters along the treadmill is the second aspect of the game.

The object of the example game illustrated in FIGS. 7A-7G is for the game characters to run along the treadmill from a starting position on the left side of the treadmill towards the end position of the treadmill (i.e., past the right-most edge of the treadmill). If a game character manages to run on the treadmill and successfully reach the end position of the treadmill, the "finish bonus" of the corresponding reel set at the time the game character reaches the end of the treadmill is considered "safe" such that it is awarded to the player at the end of the session. If the game character falls off the treadmill (by being moved backwards such that it falls of the left-most edge of the treadmill), the game character is disqualified from the session. The associated reel set is stopped such that it no longer participates in the session. Once all four (4) of the game characters have either successfully reached the end position of the treadmill or been disqualified, the session ends. The session result comprises the sum of all "safe" finish bonuses earned during the session.

In accordance with one embodiment, the movement of the game characters is governed by a movement scheme similar to that illustrated in data structure 400 (FIG. 4). A special symbol in the form of a chili pepper is utilized in the game. If a chili pepper appears on a reel set (once the reel set is stopped for a particular turn) corresponding to a game character, that game character is advanced further towards the end position of the treadmill. Otherwise, the movement of the game character is based on which turn in the session the current turn is, in accordance with a scheme similar to that depicted in data structure 400. For example, for the first few turns of a session, the game character may not be moved backwards but only moved forward. As the session progresses, the game character may be moved backwards one (1) or two (2) movement positions for each turn, unless a special symbol appears on the reel set of that character. The probability of a special symbol is also increased. However, as the session progresses further, the probability of the special symbol appearing is decreased. The message bar 760 of each figure displays messages to the player, which message bar may be used throughout the session to explain some concepts of the game, provide tips to the player and/or encourage the player.

Turning now to FIGS. 7A-7G, progress in a game during a session is shown to illustrate some concepts and embodiments described herein. It should be noted that the screen shots of FIGS. 7A-7G depict the game interface as it may appear to a player as a session progresses over time and highlight some occurrences or events in the game, but do not illustrate all progress in the game during the session (e.g., the screen shots show "snapshots" in time, but some time and events may have passed between one screen shot and another and not be shown in the Figures, for purposes of brevity).

Figure 7A:
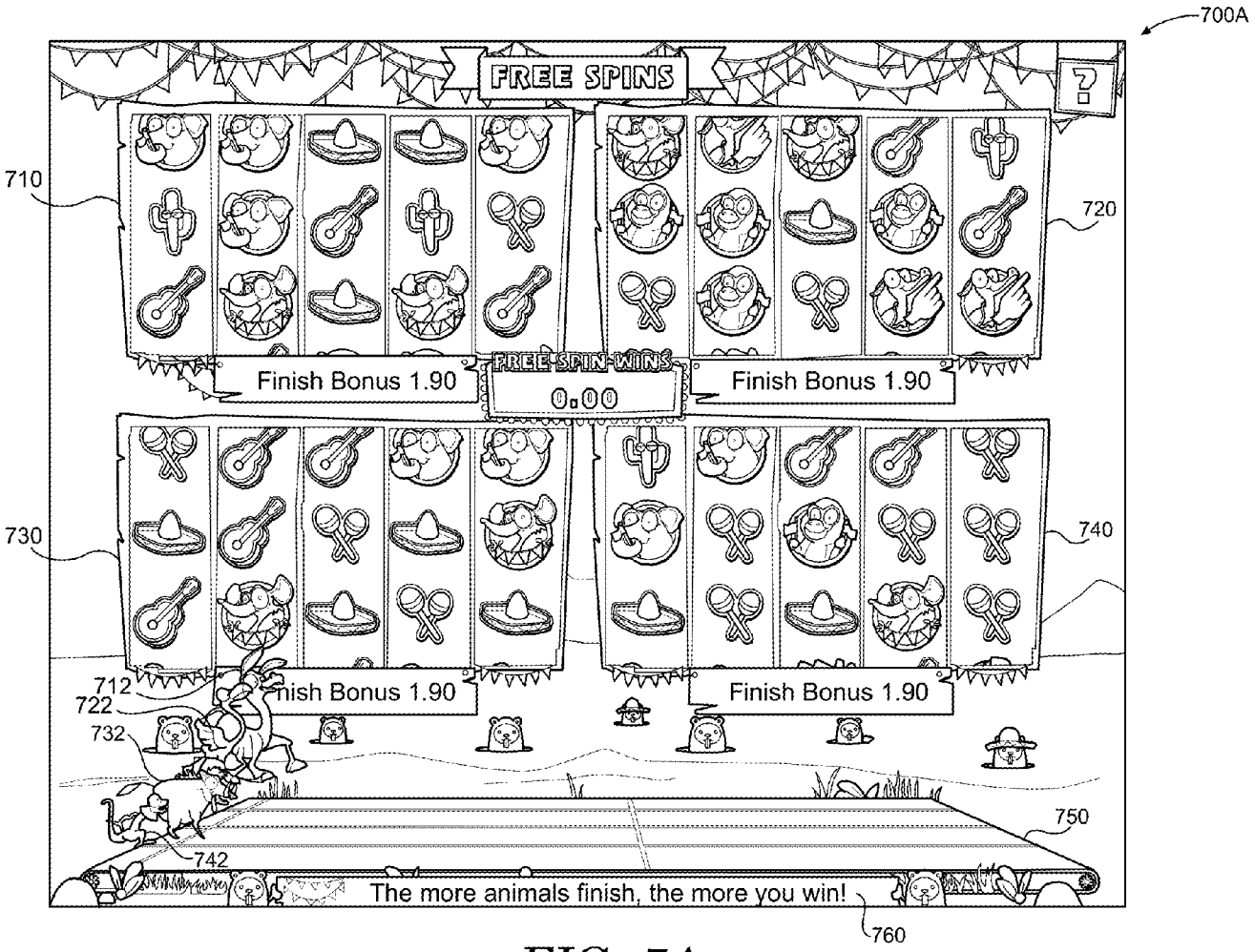
FIGS. 7A-7G comprise screen shots of a game interface illustrating progression of a game over time, according to one or more embodiments described herein.
Figure 7B:
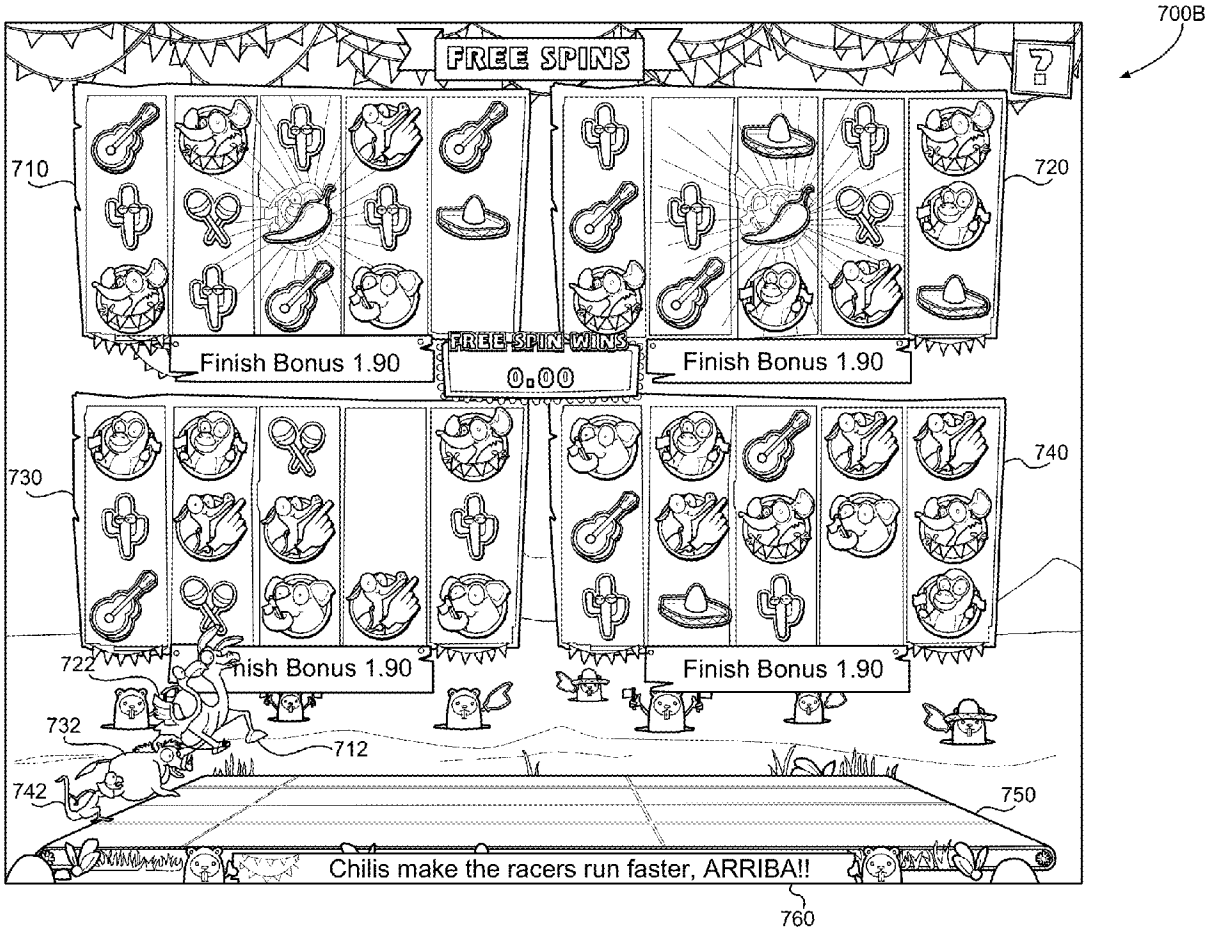
Figure 7C:
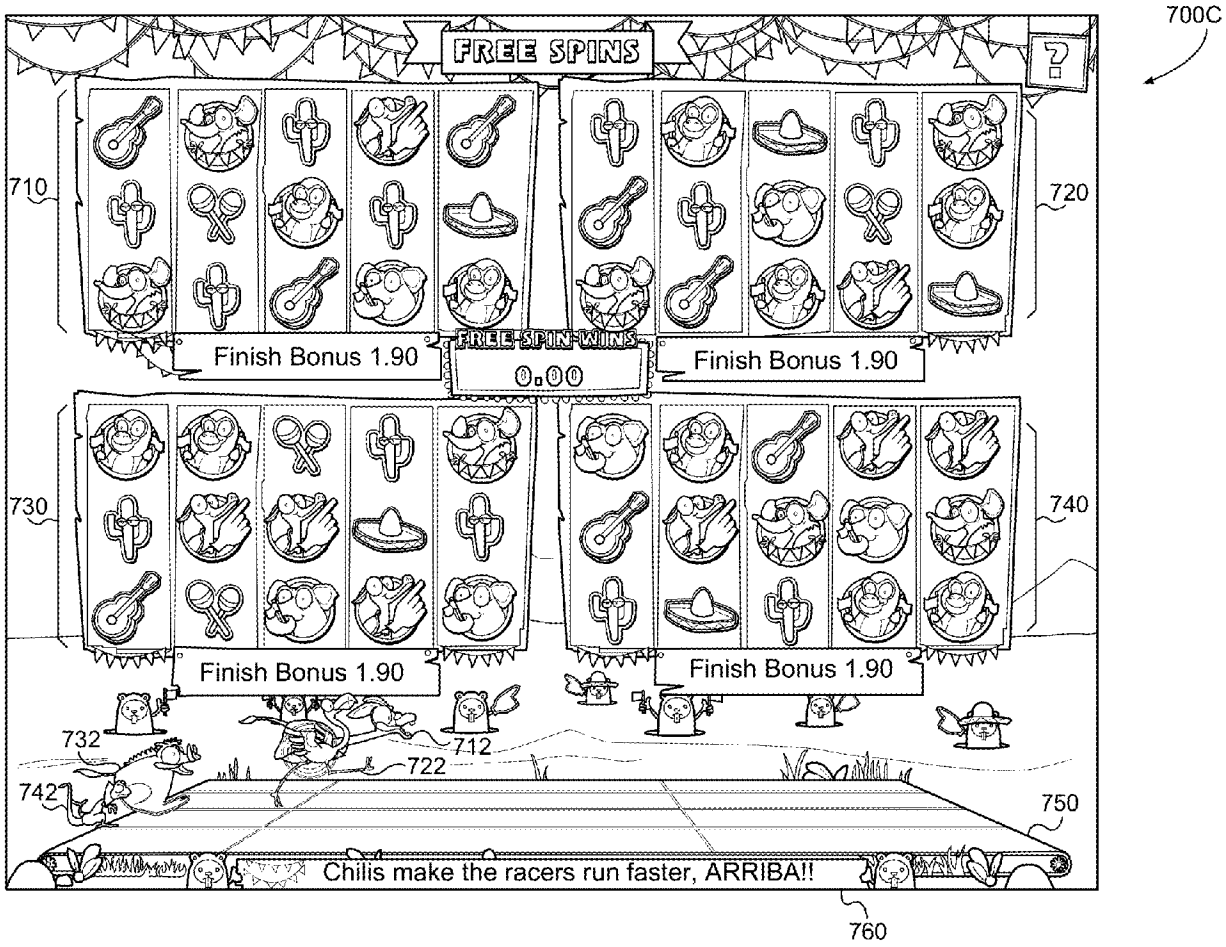
Figure 7D:
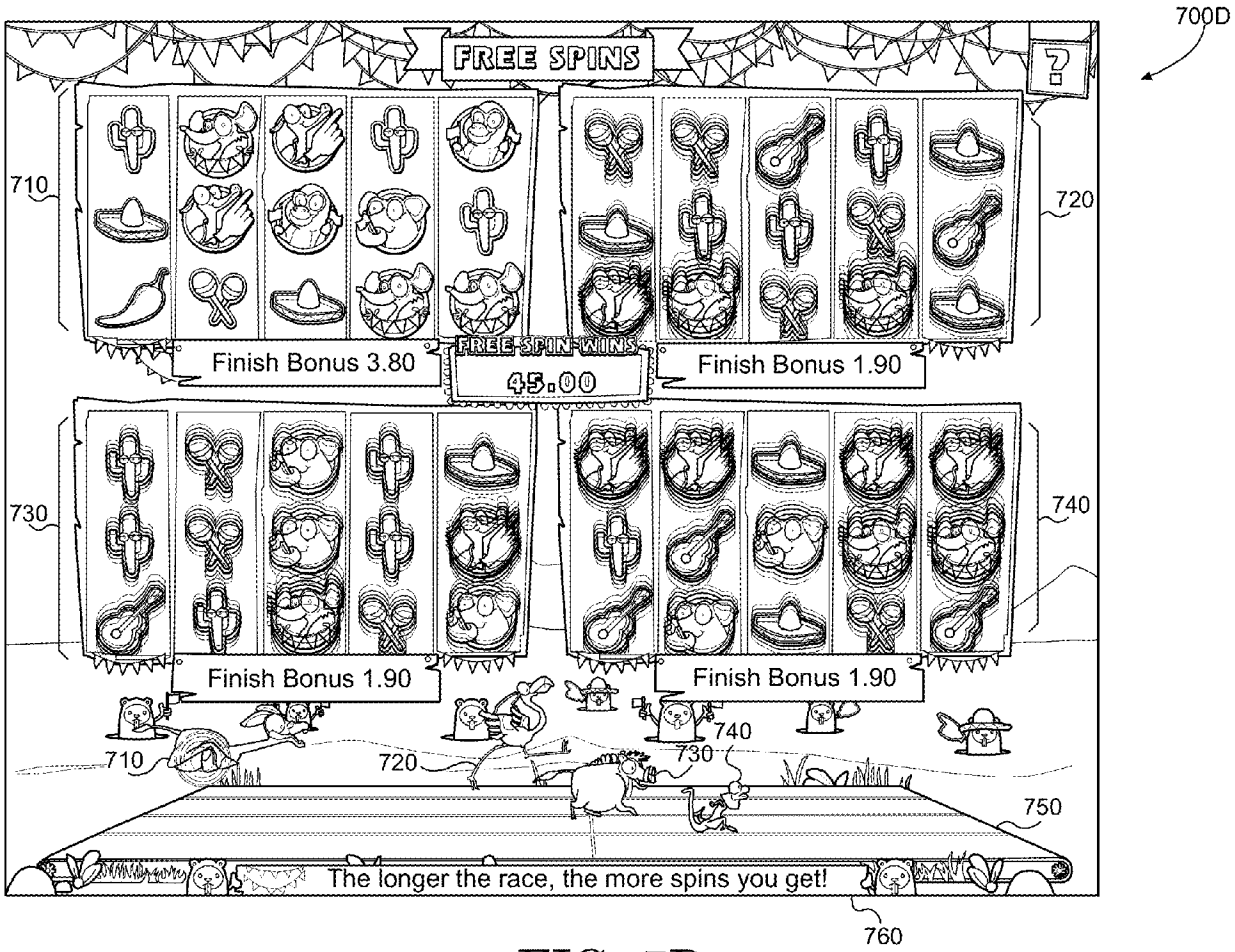
Figure 7E:
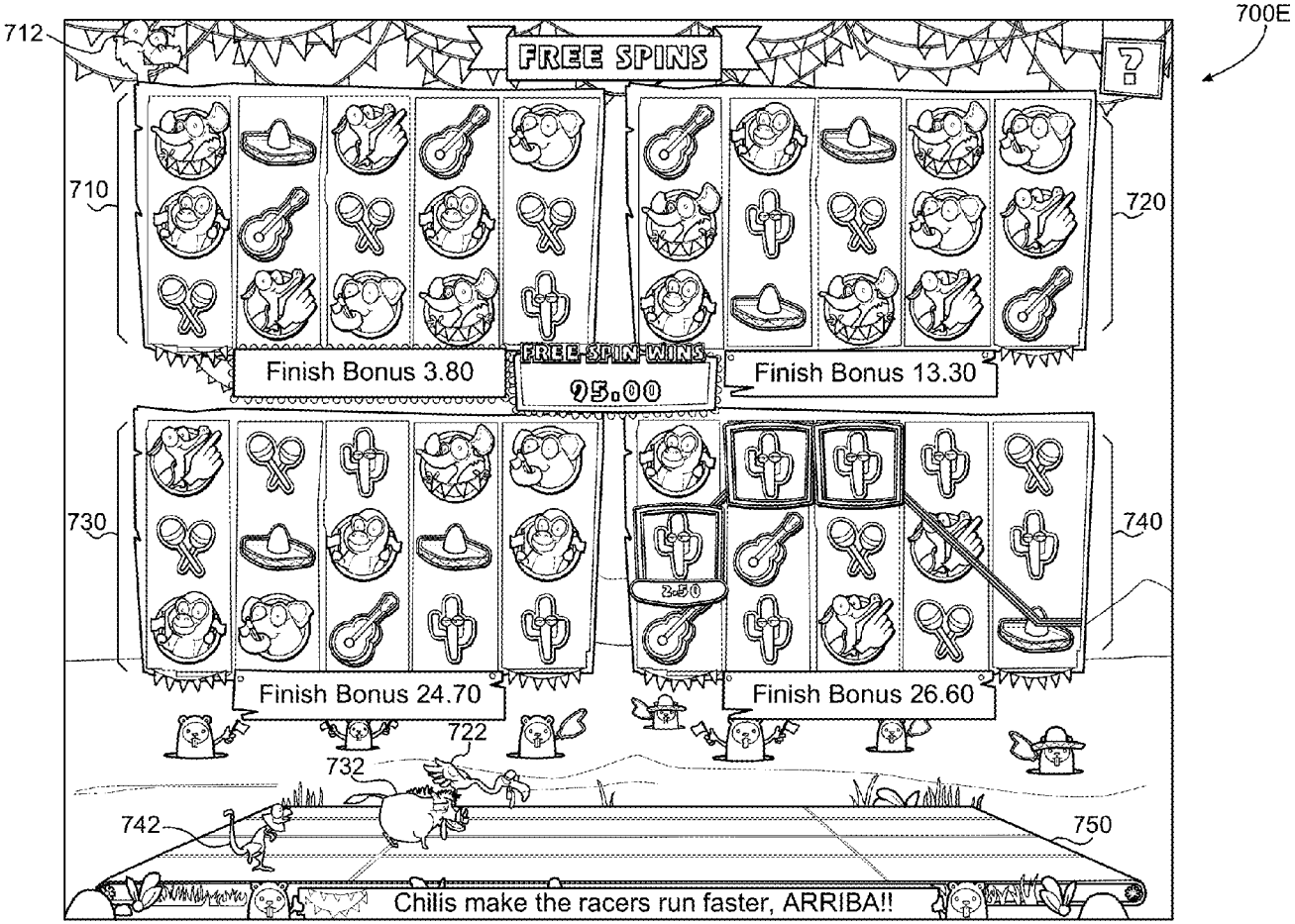
Figure 7F:
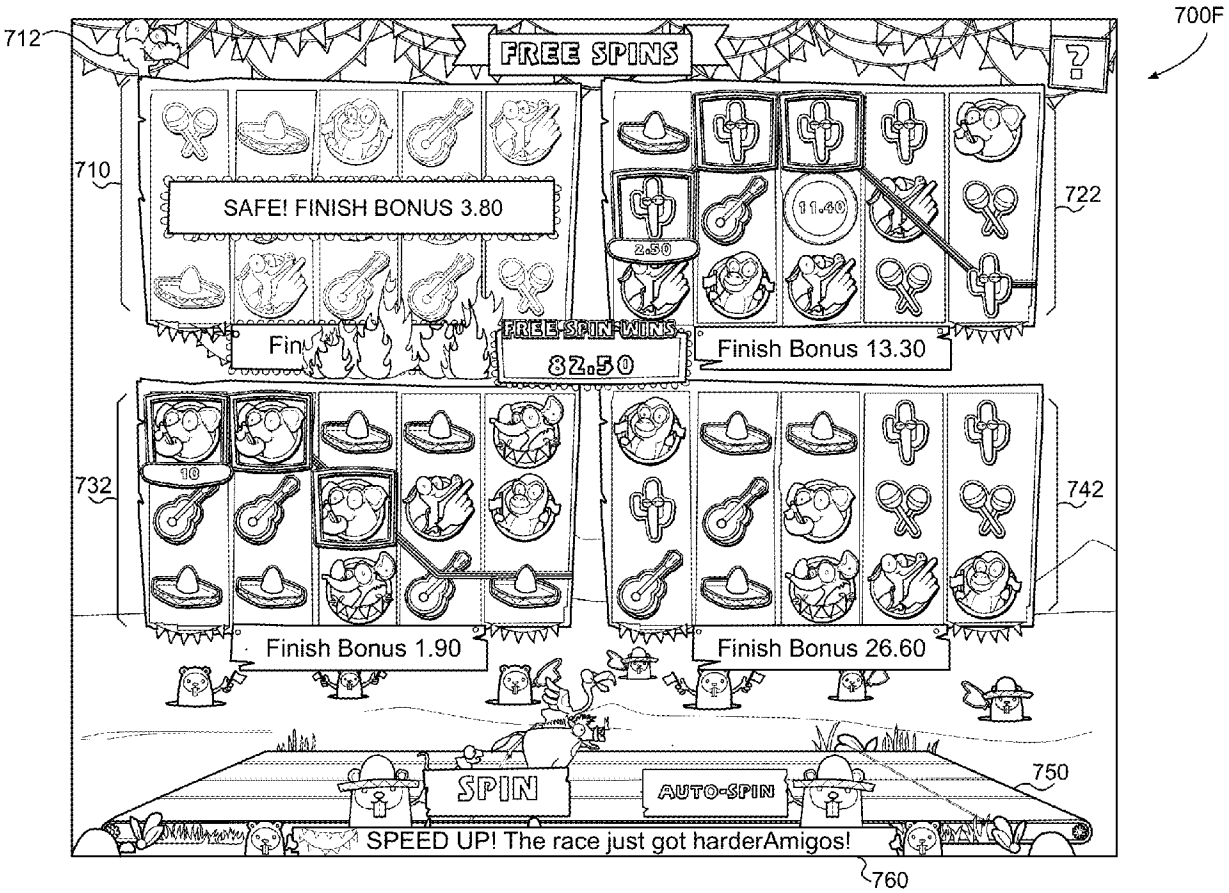
Figure 7G:
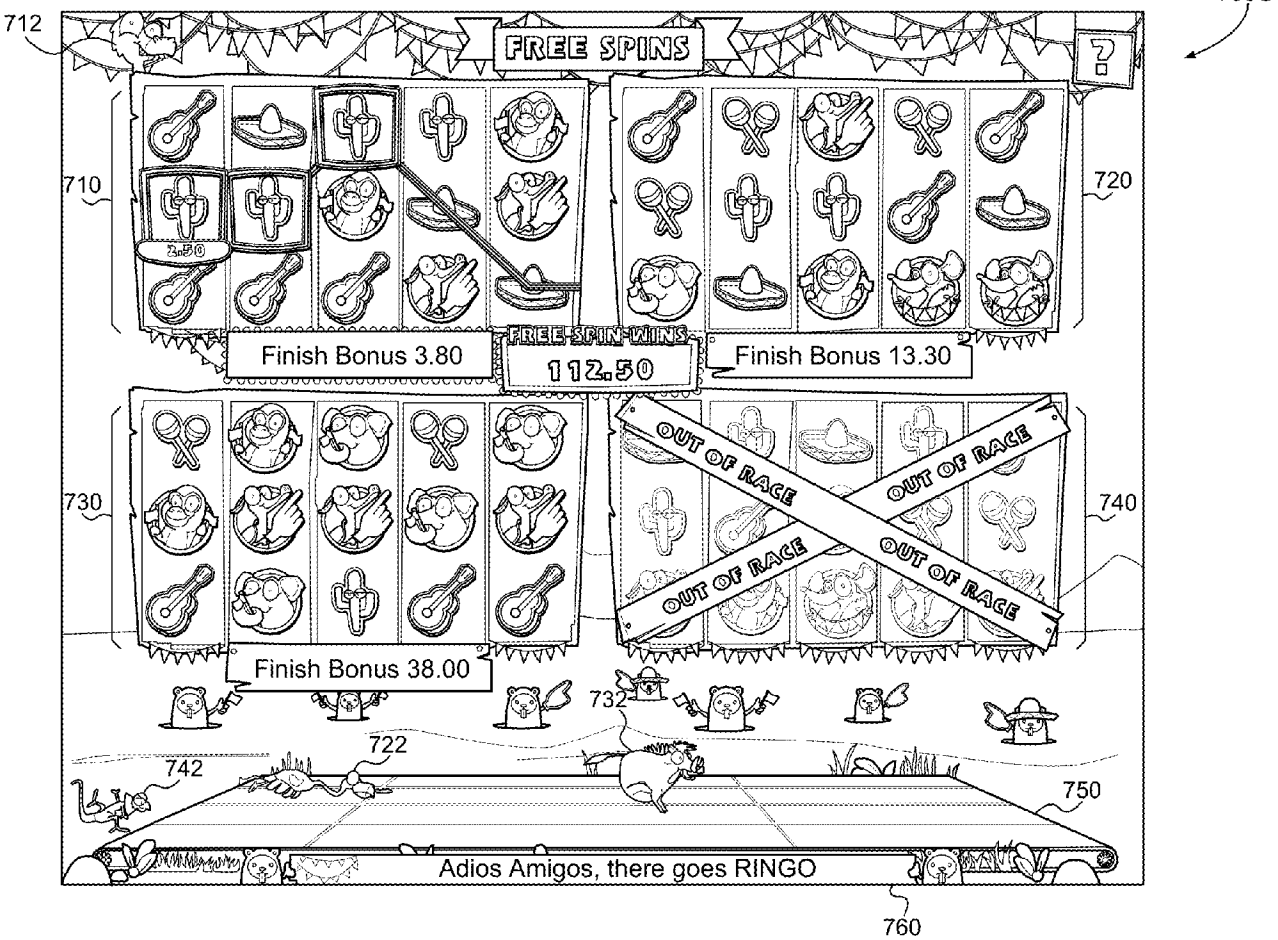

Turning now to FIG. 7A, illustrated therein is a screen shot of the characters as they may appear at the very beginning of the session, with all four (4) characters at the beginning position of the treadmill. In FIG. 7B, it is shown that a special symbol comprise a second outcome of reel set 710 and reel set 720. In FIG. 7C, it is shown that as a result of the appearance of the special symbols on the respective reels, the corresponding characters 712 and 722 have advance further towards the end position of the treadmill. FIG. 7D shows the game character 712 as falling dangerously behind as the session progresses, almost falling off the left-most edge of the treadmill despite having been one of the first game characters to advance as shown in FIG. 7C. This may be, perhaps, to the reel set 710 not displaying any special symbols (chilies) for several turns of the session. FIG. 7E illustrates that as the session progressed, the game character 710 successfully finished the race (the game character 712 is not illustrated along the top left corner of the corresponding reel set 710 and is no longer on the treadmill). This may have happened, for example, because the reel set 710 showed multiple special symbols as comprising second outcomes of the session (e.g., over several turns of the session) as the session progressed. FIG. 7F illustrates a "safe" message over the reel set 710 and the finish bonus earned by the game character. FIG. 7G illustrates that the game character 742 has been disqualified from the race because the game character has been moved backwards past the left-most edge of the treadmill. Thus, as illustrated in FIGS. 7A-7G, a second aspect of a game may be very dynamic in nature.

The above description of FIGS. 7A-7G are one example of how a process such as process 600 may be applied to evaluate and apply first outcomes and second outcomes of a game over the course of a session and to determine a session result. For example, assuming game character 722 successfully finished the race with a finish bonus of "5" and game character 732 was disqualified, the session may be determined to be complete and the session result may be determined to be "8.80" (the sum of the finish bonuses from game character 712 and game character 732).

Although various specific embodiments and example have been described herein, the scope of the invention(s) described herein should not be construed in a limiting fashion based on any description of any particular embodiment, example or illustration. Various modifications of embodiments would be evident to one of ordinary skill in the art upon reading the present disclosure.

F. Interpretation

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

Neither the Title (set forth at the beginning of the first page of this disclosure) nor the Abstract (set forth at the end of this disclosure) is to be taken as limiting in any way as the scope of the disclosed invention(s).

The term "product" means any machine, manufacture and/or composition of matter as contemplated by 35 U.S.C. §101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things) means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Where a limitation of a first claim would cover one of a feature as well as more than one of a feature (e.g., a limitation such as "at least one widget" covers one widget as well as more than one widget), and where in a second claim that depends on the first claim, the second claim uses a definite article "the" to refer to the limitation (e.g., "the widget"), this does not imply that the first claim covers only one of the feature, and this does not imply that the second claim covers only one of the feature (e.g., "the widget" can cover both one widget and more than one widget).

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device or article is described herein, more than one device or article (whether or not they cooperate) may alternatively be used in place of the single device or article that is described. Accordingly, the functionality that is described as being possessed by a device may alternatively be possessed by more than one device or article (whether or not they cooperate).

Similarly, where more than one device or article is described herein (whether or not they cooperate), a single device or article may alternatively be used in place of the more than one device or article that is described. For example, a plurality of computer-based devices may be substituted with a single computer-based device. Accordingly, the various functionality that is described as being possessed by more than one device or article may alternatively be possessed by a single device or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system". A control system, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

The present disclosure provides, to one of ordinary skill in the art, an enabling description of several embodiments and/or inventions. Some of these embodiments and/or inventions may not be claimed in the present application, but may nevertheless be claimed in one or more continuing applications that claim the benefit of priority of the present application. Applicants intend to file additional applications to pursue patents for subject matter that has been disclosed and enabled but not claimed in the present application.

What is claimed is:

1. A gaming system for conducting a game played via a player device, the gaming system comprising:

a first gaming server storing an electronic number generator operable to randomly generate an output based upon which a first outcome for at least a first aspect of a game may be determined, the first gaming server comprising at least one first processor, wherein the first aspect of the game comprises at least one set of reels corresponding to a respective game character moved along a path in a second aspect of the game and wherein primary game symbols placed on the set of reels are used to determine a magnitude of an available reward to be provided to the player in association with the corresponding game character if the game character reaches an end of the path along which it is moved prior to an end event of the second aspect of the game;

a second gaming server, operable to communicate with the first gaming server, comprising at least one second processor and a memory device for storing a plurality of instructions which, when executed by the at least one second processor, cause the at least one second processor to:

(a) receive, for a current round of the game and from the first gaming server, a first output based upon which the first outcome for at least the first aspect of the game may be determined, the first output comprising at least one of (i) a random number for use in determining the first outcome and (ii) the first outcome, wherein the first output is determined using a first probability scheme;

(b) receive, for the current round of the game and from the first game server, a second output that is determined using a second and distinct probability scheme, the second output comprising an indication that a special game symbol should be added to the set of reels for the current round of the game; and (c) provide data over a network to at least one remote player device, the data including the first output and the second output, the data instructing the at least one remote player device to:

populate, based on the first output, and within a first area of an electronic interface, a plurality of game symbol positions of the at least one set of reels with primary game symbols affecting the first aspect of the game such that a single primary game symbol is placed in each game symbol position;

overlay, on a randomly selected game symbol position of the at least one set of reels and based on the second output, the special game symbol affecting the second aspect of the game, such that the special game symbol hides from view the single primary game symbol in the randomly selected game symbol position, wherein the special game symbol causes a movement of a game character corresponding to the at least one set of reels within which the special game symbol has been overlaid along a path of the game which is displayed in a second area of the electronic game interface and further wherein the special game symbol represents a predetermined magnitude of movement along the path;

output the electronic game interface to the player as initially showing the game symbol positions as populated with the placed primary game symbols and overlaid with the special game symbol;

modify the electronic game interface by removing the special game symbol from the first area of the electronic game interface, thereby revealing the single primary game symbol hidden from view by the special game symbol;

further modify the electronic game interface by moving, within the second area of the game interface, the game character corresponding to the at least one set of reels from which the special game symbol was removed along the path based on the predetermined magnitude represented by the special game symbol;

update an available reward corresponding to the game character that was moved based on the special game symbol, for the first aspect of the game and based on a reward value corresponding to the primary game symbols placed on the at least one set of reels corresponding to the game character;

determine that the game character corresponding to the set of reels has reached an end position of their corresponding path prior to an end event for the current round of the game; and provide to the player the available reward corresponding to the game character at a time the game character reaches the end position.

2. The gaming system of claim 1, wherein the game comprises a wagering game.

3. The gaming system of claim 2, further comprising:

receiving a wager, the wager in exchange for both the first aspect of the game and the second aspect of the game.

4. The gaming system of claim 2, further comprising:

determining, during a main aspect of the wagering game, that a bonus round of the wagering game has been triggered; and performing the method of claim 1 to determine a session result for the bonus round.

5. The gaming system of claim 1, wherein the primary game symbols are randomly selected for populating the game symbol positions.

6. The gaming system of claim 1, wherein the primary game symbols populated onto the game symbol positions comprise the first outcome of the first aspect of the game and the placement of the special symbol comprises a second outcome of the second aspect of the game.

7. The gaming system of claim 6, further comprising:

randomly determining the first outcome using a first probability schedule; and randomly determining the second outcome using a second probability schedule, wherein both random determinations are completed for a single event instance of the game.

8. The gaming system of claim 7, wherein the first outcome and the second outcome are determined for a current event instance in a session comprising a plurality of event instances and further comprising:

determining whether the current event instance is a first event instance in the session or a second event instance in the session; and accessing a first record of the second probability schedule if the current event instance is a first event instance and accessing a second record of the second probability schedule if the current event instance is a second event instance.

9. The gaming system of claim 8, wherein the first record indicates a first probability of having the special symbol overlaid on the game symbol position and the second record indicates a second probability of having the special symbol overlaid on the game symbol position.

10. The gaming system of claim 8, wherein the first record indicates a positive progress of the second aspect of the game to be applied as a result of the second outcome and the second record indicates a negative progress of the second aspect of the game to be applied as a result of the second outcome.

11. The gaming system of claim 6, wherein a second outcome comprises a negative outcome such that it negatively impacts progress in the second aspect of the game.

12. The gaming system of claim 1, wherein the game comprises an online game and the gaming system facilitates providing the game over the network to an online player.

13. A game server for facilitating play of an electronic game available online to a plurality of players, wherein the electronic game comprises a first aspect and a second aspect, wherein the first aspect of the game comprises at least one set of reels corresponding to a respective game character moved along a path in the second aspect of the game and further wherein primary game symbols placed on the set of reels are used to determine a magnitude of an available reward to be provided to a player of the game in association with the corresponding game character if the game character reaches an end of the path along which it is moved prior to an end event of the second aspect of the game, the game server comprising:

a processor;

a memory storing a program for directing the processor, the processor being operable with the program to perform a method, the method comprising:

receive, for a current round of the game and from an electronic random number generator operable to randomly generate an output based upon which a first outcome for at least a first aspect of a game may be determined, a first output comprising at least one of (i) a random number for use in determining the first outcome and (ii) the first outcome, wherein the first output is determined using a first probability scheme;

receive, for the current round of the game and from a second game server, a second output that is determined using a second and distinct probability scheme, the second output comprising an indication that a special game symbol should be added to the set of reels for the current round of the game;

provide data over a network to at least one remote player device, the data including the first output and the second output, the data instructing the at least one remote player device to:

populate, based on the first output and within a first area of an electronic interface, a plurality of game symbol positions of the at least one set of reels with primary game symbols affecting the first aspect of the game such that a single primary game symbol is placed in each game symbol position;

overlay, on a randomly selected game symbol position of the at least one set of reels and based on the second output, the special game symbol affecting the second aspect of the game, such that the special game symbol hides from view the single primary game symbol in the randomly selected game symbol position, wherein the special game symbol causes a movement of a game character corresponding to the at least one set of reels within which the special game symbol has been overlaid along a path of the game which is displayed in a second area of the electronic game interface and further wherein the special game symbol represents a predetermined magnitude of movement along the path;

output the electronic game interface to the player as initially showing the game symbol positions as populated with the placed primary game symbols and overlaid with the special game symbol;

modify the electronic game interface by removing the special game symbol from the first area of the electronic game interface, thereby revealing the single primary game symbol hidden from view by the special game symbol;

further modify the electronic game interface by moving, within the second area of the game interface, the game character corresponding to the at least one set of reels from which the special game symbol was removed along the path based on the predetermined magnitude represented by the special game symbol;

update an available reward corresponding to the game character that was moved based on the special game symbol, for the first aspect of the game and based on a reward value corresponding to the primary game symbols placed on the at least one set of reels corresponding to the game character;

determine that the game character corresponding to the set of reels has reached an end position of their corresponding path prior to an end event for the current round of the game; and provide to the player the available reward corresponding to the game character at a time the game character reaches the end position.

14. A non-transitory computer-readable medium storing instructions for directing a processor to facilitate a game having a first aspect and a second aspect, wherein the first aspect of the game comprises at least one set of reels corresponding to a respective game character moved along a path in the second aspect of the game and further wherein primary game symbols placed on the set of reels are used to determine a magnitude of an available reward to be provided to a player of the game in association with the corresponding game character if the game character reaches an end of the path along which it is moved prior to an end event of the second aspect of the game, the instructions causing the processor to perform a method comprising:

receive, for a current round of the game and from a first gaming server, an output based upon which a first outcome for at least a first aspect of a game may be determined, a first output comprising at least one of (i) a random number for use in determining the first outcome and (ii) the first outcome, wherein the first output is determined using a first probability scheme;

receive, for the current round of the game and from a second game server, a second output that is determined using a second and distinct probability scheme, the second output comprising an indication that a special game symbol should be added to the set of reels for the current round of the game; and provide data over a network to at least one remote player device, the data including the first output and the second output, the data instructing the at least one remote player device to:

populate, based on the first output, and within a first area of an electronic interface, a plurality of game symbol positions of the at least one set of reels with primary game symbols affecting the first aspect of the game such that a single primary game symbol is placed in each game symbol position;

overlay, on a randomly selected game symbol position of the at least one set of reels and based on the second output, the special game symbol affecting the second aspect of the game, such that the special game symbol hides from view the single primary game symbol in the randomly selected game symbol position, wherein the special game symbol causes a movement of a game character corresponding to the at least one set of reels within which the special game symbol has been overlaid along a path of the game which is displayed in a second area of the electronic game interface and further wherein the special game symbol represents a predetermined magnitude of movement along the path;

output the electronic game interface to the player as initially showing the game symbol positions as populated with the placed primary game symbols and overlaid with the special game symbol;

modify the electronic game interface by removing the special game symbol from the first area of the electronic game interface, thereby revealing the single primary game symbol hidden from view by the special game symbol;

further modify the electronic game interface by moving, within the second area of the game interface, the game character corresponding to the at least one set of reels from which the special game symbol was removed along the path based on the predetermined magnitude represented by the special game symbol;

updating an available reward corresponding to the game character that was moved based on the special game symbol, for the first aspect of the game and based on a reward value corresponding to the primary game symbols placed on the at least one set of reels corresponding to the game character;

determine that the game character corresponding to the set of reels has reached an end position of their corresponding path prior to an end event for the current round of the game; and provide to the player the available reward corresponding to the game character at a time the game character reaches the end position.

* * * * *